US007874963B2

(12) United States Patent
Grind

(10) Patent No.: US 7,874,963 B2
(45) Date of Patent: Jan. 25, 2011

(54) EXERCISE DEVICE WITH ADAPTIVE CURVED TRACK MOTION

(75) Inventor: Steven M. Grind, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 0 days.

(21) Appl. No.: 12/317,584

(22) Filed: Dec. 29, 2008

(65) Prior Publication Data

US 2010/0167883 A1 Jul. 1, 2010

(51) Int. Cl.
*A63B 69/18* (2006.01)

(52) U.S. Cl. ..... 482/71; 482/51; 482/52; 482/70

(58) Field of Classification Search ..... 482/71, 482/66, 69, 70, 146, 52
See application file for complete search history.

(56) References Cited

U.S. PATENT DOCUMENTS

| | | | | |
|---|---|---|---|---|
| 5,792,029 | A * | 8/1998 | Gordon | 482/52 |
| 5,919,118 | A | 7/1999 | Stearns et al. | 482/51 |
| 6,152,859 | A | 11/2000 | Stearns | 482/52 |
| 6,196,948 | B1 | 3/2001 | Stearns et al. | 482/52 |
| 6,277,054 | B1 | 8/2001 | Kuo | 482/51 |
| 6,340,340 | B1 * | 1/2002 | Stearns et al. | 482/52 |
| 6,361,476 | B1 | 3/2002 | Eschenbach | 482/52 |
| 6,482,132 | B2 * | 11/2002 | Eschenbach | 482/52 |
| 6,689,019 | B2 * | 2/2004 | Ohrt et al. | 482/52 |
| 6,840,892 | B1 | 1/2005 | Wu | 482/51 |
| 6,849,033 | B1 * | 2/2005 | Stearns et al. | 482/52 |
| 7,104,929 | B1 | 9/2006 | Eschenbach | 482/52 |
| 7,121,984 | B1 | 10/2006 | Hong | 482/52 |
| 7,214,168 | B2 * | 5/2007 | Rodgers, Jr. | 482/52 |
| 7,377,881 | B2 | 5/2008 | Moon | 482/52 |
| 7,494,449 | B2 * | 2/2009 | Eschenbach | 482/57 |
| 7,658,698 | B2 * | 2/2010 | Pacheco et al. | 482/52 |
| 7,717,828 | B2 * | 5/2010 | Simonson et al. | 482/52 |
| 2001/0036886 | A1 | 11/2001 | Eschenbach | 482/142 |
| 2004/0224825 | A1 | 11/2004 | Giannelli et al. | 482/52 |
| 2005/0124466 | A1 | 6/2005 | Rodgers, Jr. | 482/52 |
| 2005/0124467 | A1 | 6/2005 | Rodgers, Jr. | 482/52 |
| 2006/0172862 | A1 * | 8/2006 | Badarneh et al. | 482/52 |
| 2006/0199702 | A1 | 9/2006 | Eschenbach | 482/52 |
| 2006/0217234 | A1 | 9/2006 | Rodgers, Jr. | 482/52 |
| 2006/0234838 | A1 | 10/2006 | Dalebout et al. | 482/57 |
| 2007/0032348 | A1 | 2/2007 | Hong | 482/52 |
| 2007/0087906 | A1 | 4/2007 | Rodgers, Jr. | 482/52 |
| 2007/0087907 | A1 | 4/2007 | Rodgers, Jr. | 482/52 |
| 2007/0219061 | A1 * | 9/2007 | Rodgers, Jr. | 482/52 |
| 2007/0219062 | A1 | 9/2007 | Rodgers, Jr. | 482/52 |
| 2007/0232457 | A1 | 10/2007 | Porth | 482/51 |
| 2007/0298936 | A1 | 12/2007 | Ohrt et al. | 482/52 |
| 2008/0032869 | A1 * | 2/2008 | Pacheco et al. | 482/52 |
| 2008/0051260 | A1 | 2/2008 | Simonson et al. | 482/52 |
| 2008/0064572 | A1 | 3/2008 | Nardone | 482/52 |
| 2008/0161164 | A1 * | 7/2008 | Stewart et al. | 482/52 |

* cited by examiner

*Primary Examiner*—Loan Thanh
*Assistant Examiner*—Shila Abyaneh
(74) *Attorney, Agent, or Firm*—Terence P. O'Brien; Todd A. Rathe

(57) ABSTRACT

An exercise device reciprocates footpads along curved tracks having first pivotally supported ends and second ends that are alternately raised and lowered with respect to one another.

23 Claims, 4 Drawing Sheets

EXERCISE DEVICE WITH ADAPTIVE CURVED TRACK MOTION

BACKGROUND

Most exercise devices provide a fixed predetermined exercise path of motion. Some exercise devices now provide a user-defined exercise path of motion. However, such exercise devices utilize structural elements that are cantilevered, increasing structural rigidity requirements and increasing overall weight of the exercise device. Other such exercise devices provide exercise paths of motion having a less than desirable feel.

DETAILED DESCRIPTION OF THE EXAMPLE EMBODIMENTS

Figure 1:
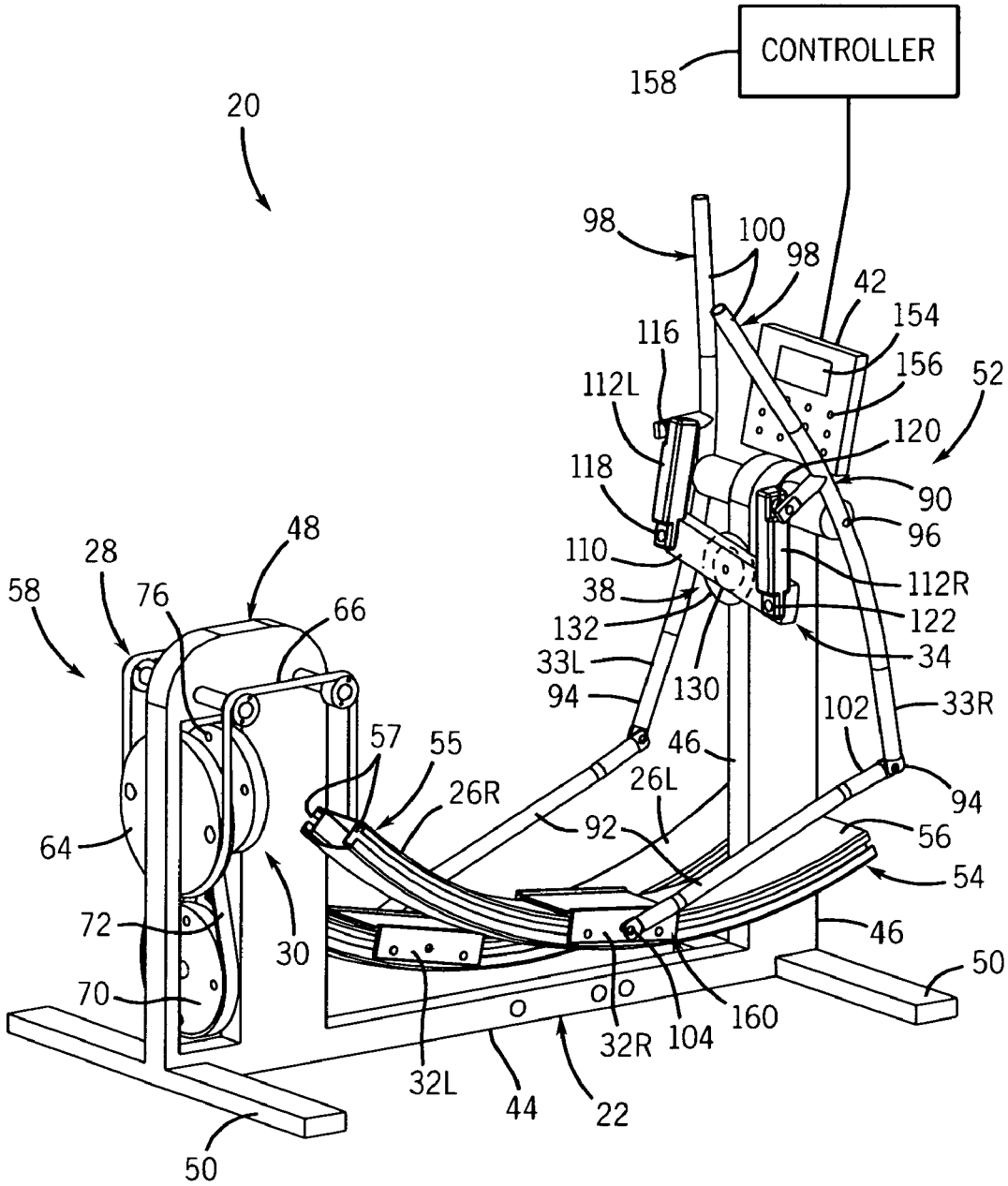
FIG. 1 is a perspective view of an exercise device according to an example embodiment.

FIG. 1 illustrates exercise device 20 according to an example embodiment. As will be described hereafter, exercise device 20 provides a person exercising with a plurality of user selectable motion paths. The user is able to change between different available paths by simply applying different forces to foot links of the exercise device. Exercise device 20 provides such freedom of motion with relatively few, if any, cantilevered structural elements. As a result, the structural rigidity and the overall weight of exercise device 20 may be reduced. In addition, exercise device 20 provides user selectable paths of motion which have an enhanced user feel.

Figure 2:
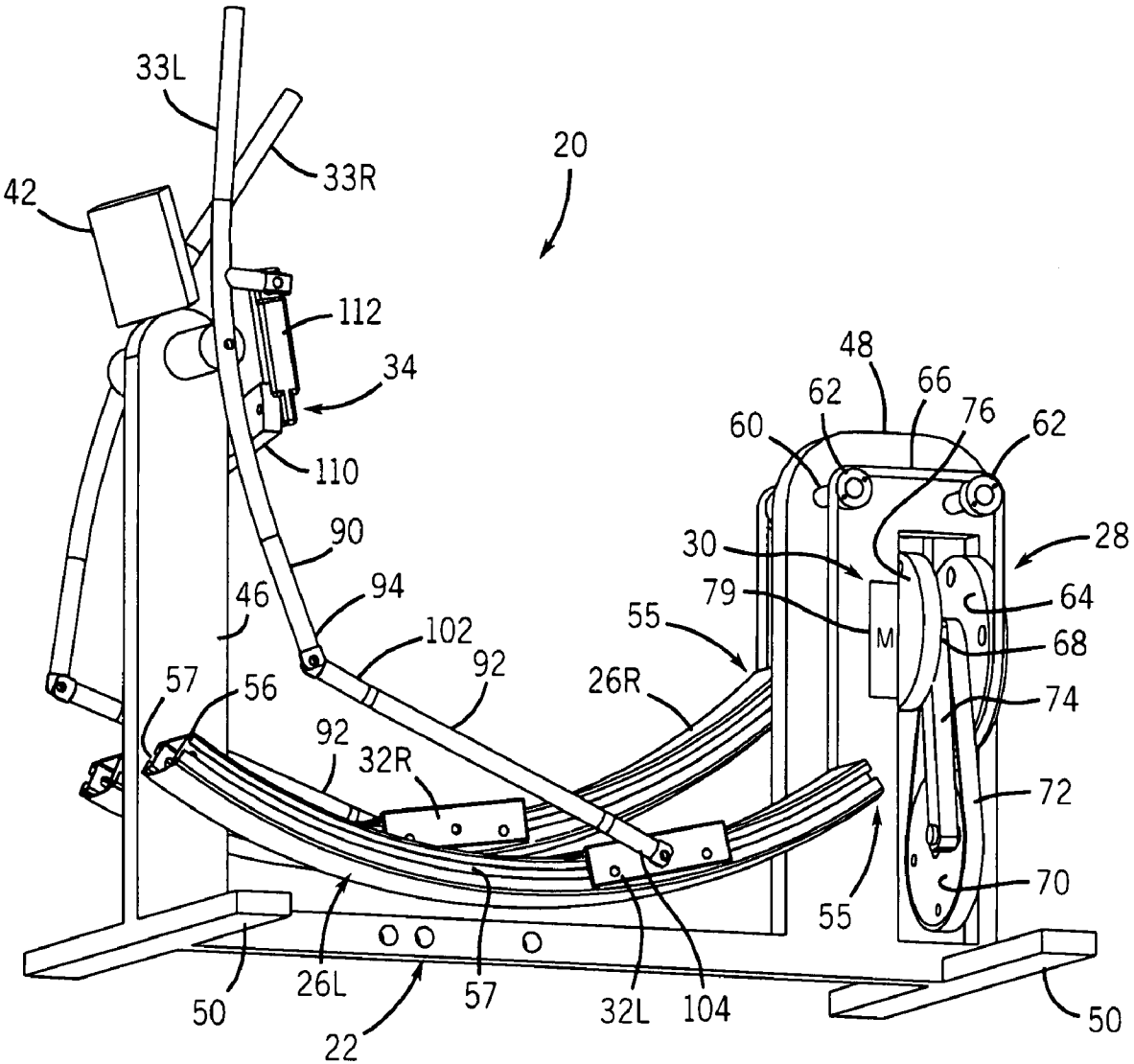
FIG. 2 is another perspective view of the exercise device of FIG. 1.

Exercise device 20 includes frame 22, tracks 26R, 26L (collectively referred to as tracks 26), track drive 28, vertical variable resistance source 30 (shown in FIG. 2), foot pads 32R, 32L (collectively referred to as foot pads 32), swing arms 33R, 33L (collectively referred to as swing arms 33), foot pad synchronizer 34, horizontal variable resistance source 38 and control panel 42. Frame 22 comprises one or more structures fastened, bonded, welded or integrally formed with one another to form a base, foundation or main support body configured to support remaining components of exercise device 20. Portions of frame 22 further serve to assist in stabilizing exercise device 20 as well as to provide structures that a person exercising may engage or grasp when mounting or de-mounting exercise device 20.

As shown by FIG. 1, frame 22 includes base 44, front upright 46 and rear upright 48. Base 44 comprises one or more structures extending along a bottom of exercise device 20 configured to support exercise device 20 upon a support surface, floor, foundation and the like. Base 44 includes outwardly extending feet, pedestals or extensions 50 which further assist in stabilizing exercise device 20. In other embodiments, base 44 may have other configurations.

Front upright 46 comprises one or more structures providing a column, post, stanchion or the like extending upwardly from base 44 at a forward or front end 52 of exercise device 20. Upright 46 supports control panel 42. Upright 46 further pivotally supports tracks 26 and swing arms 33. In other embodiments, upright 46 may have other configurations. In still other embodiments, upright 46 may be omitted.

Rear upright 48 comprises one or more structures providing a column, post, stanchion or the like extending upwardly from base 44 at a forward or front end 52 of exercise device 20. Rear upright 48 suspends portions of tracks 26. Rear upright 48 further supports track drive 28 and vertical variable resistance source 30.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Tracks 26 comprise one or more structures that are configured to guide movement or reciprocation of foot pads 32. Each of tracks 26 has a first end 54 pivotally connected to front upright 46 of frame 22 and a second elevated end 55 elevated and supported by track drive 28 and rear upright 48 of frame 22. Because each of tracks 26 is pivotally supported at one end and is elevated and supported at a second end, little if any weight of the person exercising or the weight of tracks 26 is cantilevered. As a result, frame 22, tracks 26 and other components of exercise device 20 may be formed from less rigid or less strong members or materials, reducing weight and cost.

In the example illustrated, tracks 26R and 26L extend along and guide reciprocal movement of foot link assemblies 30 along curved paths centered along parallel axes. Because tracks 26 are curved or arcuate, tracks 26 smoothly guide motion of foot pads 32 in a curved or arcuate path as foot pads 32 are reciprocated back and forth. It has been found that this arcuate path provides a person exercising with a smoother or desirable feel. In particular, the curvature of the tracks reduces or eliminates "dead spots" along a length of the curved tracks. Such dead spots that might otherwise occur constitute locations where additional force or effort may be required to initiate movement of foot link assemblies 30.

Because tracks 26 are curved, stability is also enhanced. In particular, when tracks 26 are at rest, foot pads 32 naturally move to the lowest point in space along tracks 26 due to gravity. Absent movement attracts 26, foot pads 30 to substantially remain at the lowest point. As a result, foot pads 32 are more likely to remain in place as a person mounts and dismounts exercise device 20.

According to one embodiment, tracks 26R and 26L have the same radius of curvature of between about 30 inches and about 48 inches, nominally about 32 inches. In other embodiments, portions of each of tracks 26 may have different radius is of curvature with respect to one another. For example, in one embodiment, a front portion of each of tracks 26 may flatten out so as to have a greater radius of curvature as compared to the rear portion. In another embodiment, a rear portion of each of tracks 26 may flatten out so as to have a greater radius of curvature as compared to the front portion. In yet other embodiments, both the front portion and the rear portion of each of tracks 26 may have a smaller radius of curvature as compared to a central portion of such tracks 26, wherein the smaller radius of curvature at the ends of the tracks 26 provides the user with an end of travel indication. In other words, as foot pads 32 approach the ends of tracks 26, resistance naturally increases due to the reduced radius of curvature of tracks 26.

In the particular example illustrated, each of tracks 26 comprises an elongate symmetrical member having smooth upper surfaces 56 and a pair of opposite side channels 57. Surfaces 56 provide a smooth low friction interface with foot pads 32. In one embodiment, surfaces 56 may be coated with a low friction material such as polytetraflouroethylene.

Side channels 57 comprise grooves configured to slidably receive projections extending from foot pads 32 so as to guide movement of foot pads 32 along tracks 26. In the example illustrated, site channels 57 are C-shaped to capture and retain the projections of footpads 32. Because each of tracks 26 is substantially symmetrical, tracks 26 may be extruded, racing that rotation cost and complexity. In other embodiments, tracks 26 may other configurations.

Track drive 28 comprises a drive mechanism configured to alternately raise and lower end 56 of tracks 26. Track drive 28 is located at a rear end 58 of exercise device 20 and is elevated or supported by rear upright 48 of frame 22. As the shown by FIG. 2, track drive 28 includes support posts 60, belt guides 62, pulley 64, belt 66, cluster pulley 68, intermediate pulley 70, belt 72, lever arm 74 and flywheel 76. Support posts 240 extend from portion 52 of frame 22 and support belt guides 242. Belt guides 242 comprise pulleys or rollers against which belt 66 partially wraps and are guided.

Pulley 64 is rotationally supported by portion 52 of frame 22. Belt 66 comprises a flexible elongate member having a first end 258 connected or fixed to track 26R and a second opposite end 260 fastened mounted or otherwise secured to track 26L. Belt 66 wraps at least partially about guides 242 and about a lower end of pulley 64. As a result, belt 66 suspends end 74 of tracks 26 such that tracks 26 move in a phased relationship 180 degrees out of phase with respect to one another. In other words, as one of tracks 26 is rising, the other of tracks 26 is falling.

Cluster pulley 68, pulley 70, belt 72, lever arm 74 and flywheel 76 serve to create momentum or inertia during the movement of tracks 26 to reduce or eliminate dead spots are dead zones wear movement of tracks 26 would otherwise slow down such as when tracks 26 are acted their upper or lower ends of travel. Cluster pulley 68 is fixedly coupled to or secured to pulley 64 so as to rotate with pulley 64. Cluster pulley 68 has a reduced outer diameter as compared to that of pulley 64. Pulley 70 is rotationally supported by portion 52 of frame 22. Belt 72 comprises a continuous belt wrapping about pulleys 64 and 70. Pulleys 64, 70 and belt 72 serve as a speed reducer.

Lever arm 74 comprises an elongate member having a first end eccentrically and rotationally connected to pulley 70 and a second end eccentrically and rotationally connected to flywheel 76. Flywheel 76 is rotationally supported by portion 52 of frame 22. Lever arm 74 and the location to which the ends of lever arm 74 are connected to flywheel 76 are configured such that as tracks 26 move up and down, their motion is transmitted to flywheel 76 so as to continuously rotate flywheel 76 in a single direction. This continuous rotation of flywheel 76 creates inertia or momentum to reduce or eliminate the occurrence of dead zones or stalled zones wear movement of tracks 26 would otherwise be slowed or stalled at its ends of travel.

Vertical resistance source 30 comprises a source of controllable and adjustable resistance against the raising and lowering of ends 74 of tracks 26. In the example illustrated, vertical resistance source 30 comprises an Eddy brake system. In particular, vertical resistance source 30 includes a magnet 79 (schematically shown) positioned opposite to flywheel 76, wherein flywheel 76 is formed from a ferrous or ferromagnetic material.

Magnet 79 comprises a magnetic member configured and located so as to apply a magnetic field to flywheel 76. In the example illustrated, magnet 79 extends generally opposite to a face of flywheel 76. The magnetic field applied to flywheel 76 by magnet 79 creates eddy currents that themselves create opposing magnetic fields that resist relative rotation of flywheel 76. By resisting relative rotation of flywheel 76, rotation of pulley 64 is also resisted. As a result vertical up and down movement of tracks 26 is resisted.

The resistance applied by magnet 79 is adjustable and selectable by a person exercising. In one embodiment, magnet 79 comprises an electro-magnet, wherein electrical current transmitted through magnet 79 may be varied to adjust the magnetic field and the degree of resistance provided by source 30. In one embodiment, the electrical current transmitted to magnet 79 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by magnet 79 may be adjustable by physically adjusting a spacing or gap between flywheel 76 and magnet 79. For example, in one embodiment, source 30 may include an electric solenoid, voice coil or other mechanical actuator configured to move one of flywheel 76 or magnet 79 relative to one another so as to adjust the gap. In yet another embodiment, flywheel 76 may include a magnet positioned opposite to a stationary ferrous or ferromagnetic member.

Figure 3:
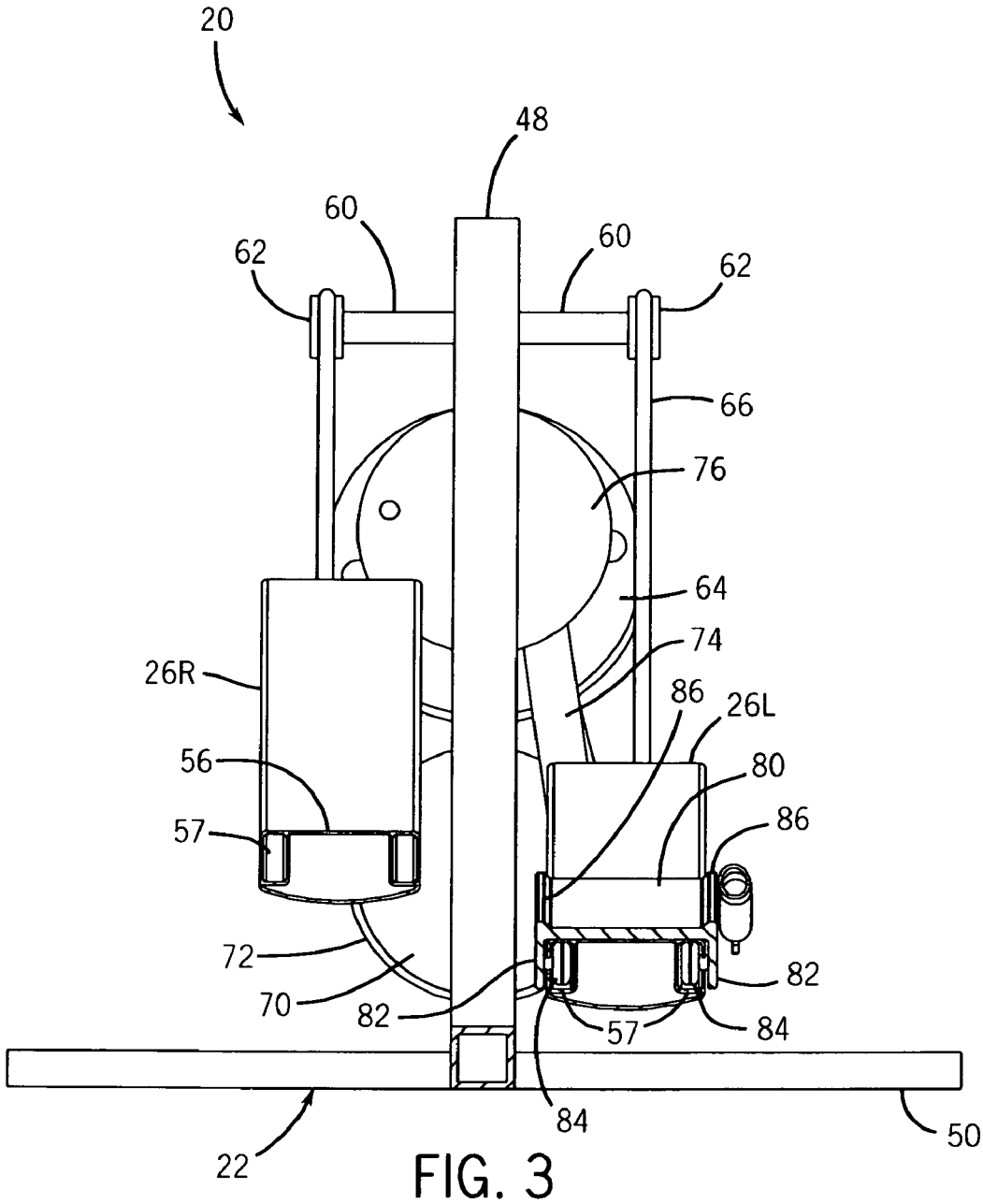
FIG. 3 is a sectional view of the exercise device of FIG. 1.
Figure 4:
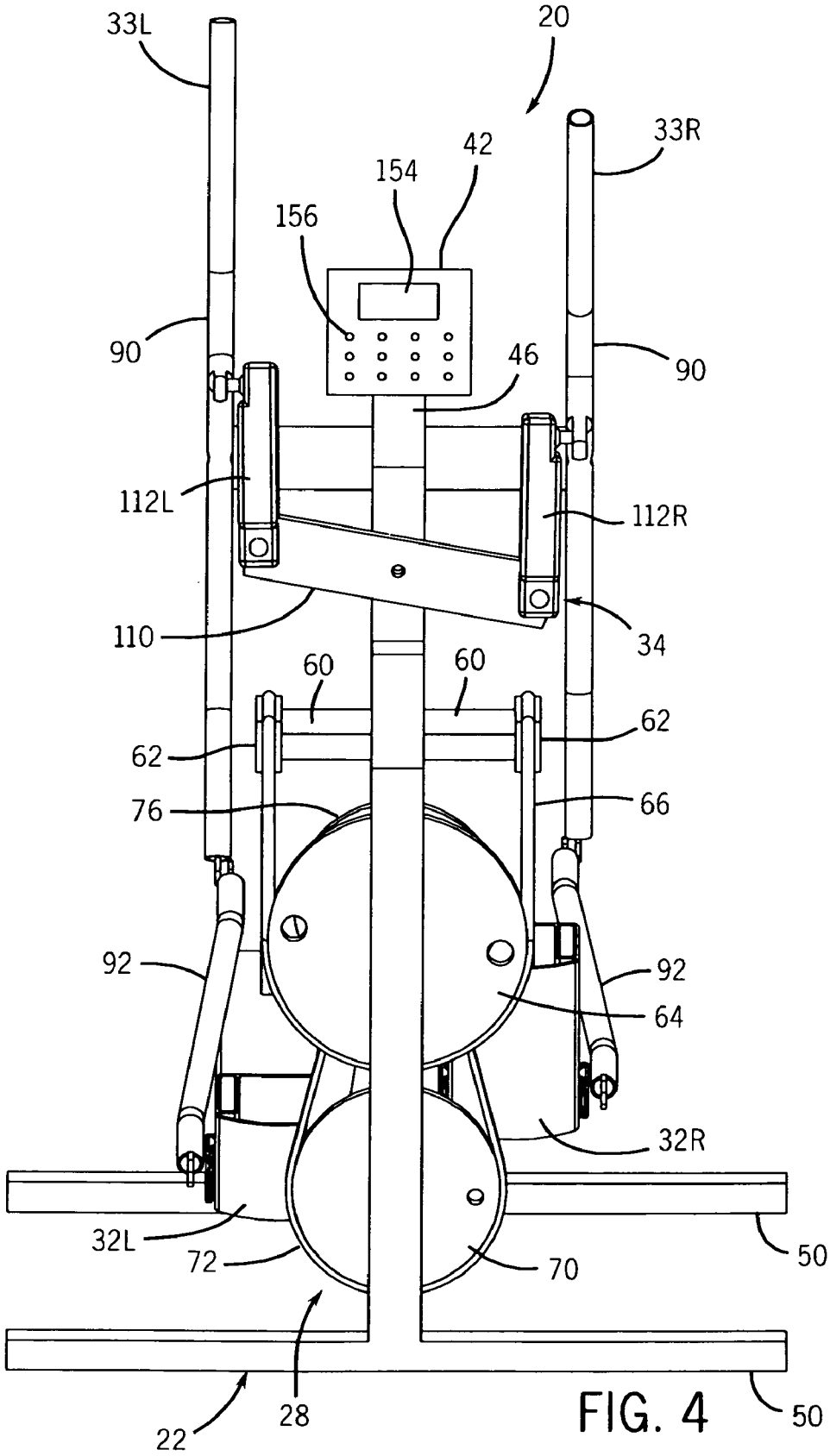
FIG. 4 is a rear elevational view of the exercise device of FIG. 1.

Foot pads 32 comprise structures slidably coupled to tracks 26 service to reciprocate along tracks 26. Foot pads 32 provide surfaces upon which a person's feet may rest and apply force. As shown in FIG. 3, each footpad 32 includes a foot platform 80, sidewalls 82 and rollers 84. Platform 80 provides a surface upon which a person may place the bottom in his or her foot. In the example illustrated, each platform 80 includes side retainers 86 which assist in retaining a person's foot upon platform 80. In other embodiments, each footpad 32 may additionally provide with other structures for assisting in the retention of a person's foot upon footpad 32 and for assisting a person in applying force to footpad 32. For example, in other embodiments, each of platforms 80 may additionally include a toe clip or toe cup.

Sidewalls 82 extend outwardly from platform 80 and support rollers 84. Rollers 84 extent energy from sidewalls 82 and are captured within site channels 57 of tracks 26. Rollers 84 provide a low friction interface for retaining footpad 32 along tracks 26 as footpads 32 reciprocate along tracks 26. In other embodiments, other low friction interface is may be utilized. For example, in other embodiment, track 26 may be provided with one or more rollers, wherein footpads 32 include grooves receiving such rollers. In yet another embodiment, slider bars having low friction surfaces, such as polytetrafluoroethylene may be utilized.

Swing arms 33 comprise elongated structures or assemblies of structures coupled to foot tracks 26 so as to swing, pivot or otherwise move with the movement of tracks 26. Swing arms 33 facilitate exercisable person's upper body and arms in synchronization with the exercise of the person's lower body or legs. Swing arms further transmit motion to footpad synchronizer 34, long footpad synchronizer 34 to synchronize the forward and rearward movement footpad 32R with the rearward and forward movement of footpad 32L. In other embodiments where other means are provided for synchronizing movement of footpads 32, swing arms 33 may be omitted or may be disconnectable from foot pads 32 so as to be mounted to frame 22 in a stationary position.

In the example illustrated, each of swing arms 33 includes a main arm 90 and intermediate link 92. Each main arm 90 has a first end portion 94 pivotally connected to an associated intermediate link 92, a second intermediate portion 96 pivotally connected to upright 46 of frame 22 and a third end portion 98 providing a handgrip 100. Handgrip 100 is configured to be grasped by a person during exercise. In the example illustrated, handgrip 100 comprise columns, wraps, bands, rings or other surface areas of soft, compressible, high friction, rubber-like foam or polymeric material. In other embodiments, handgrip 100 may be omitted or may be generally indistinguishable from a remainder of swing arm 33.

Intermediate link 92 comprise elongated link having a first end portion 102 pivotally connected to portion 94 of one of swing arms 33 and a second end portion 104 pivotally connected to one of footpads 32. Intermediate links 92 transmit motion between footpads 32 and main arms 90 of swing arms 33. In other embodiments, each of swing arms 33 may have other configurations. For example, each of swing arms 33 may include additional linkages.

Footpad synchronizer 34 comprises a mechanism configured to synchronize movement of footpads 32 relative to one another. In particular, footpad synchronizer 34 is configured to synchronize forward and rearward movement of footpad 32R with rearward and forward movement of footpad 32L. Footpad synchronizer 34 includes rocker arm 110 and synchronizer links 112L and 112R. Rocker arm 110 comprises a structure pivotally connected to upright 46 of frame 22 for pivotal movement about an axis substantially perpendicular to the axis about which main arms 90 of swing arms 33 pivot.

Synchronizer link 112L comprise a linkage having a first end 116 pivotally connected to main arm 90 of swing arm 33L and a second end 118 pivotally connected to rocker arm 110 on a first side of the pivot axis of rocker arm 110. Synchronizer link 112R comprises a linkage having a first end 120 pivotally connected to main arm 90 of swing arm 33R and a second end 122 pivotally connected to rocker arm 110 on a second side of the pivot axis of rocker arm 110. As a result of this construction, when footpad 32L is moving forwardly, footpad 32R must move rearwardly and vice versa. With this construction, footpad synchronizer 32 utilizes structure components are linkages already provided by swing arms 33, reducing the number of parsing complexity of footpad synchronizer 34. In other embodiments, other mechanisms may be utilized to synchronize movement of footpads 32. For example, other mechanisms not connected to swing arms 33 may be utilized to synchronize movement of footpads 32.

Horizontal resistance source 38 comprises a source of controllable and adjustable resistance against the forward and rearward movement of footpads 32. In the example illustrated, horizontal resistance source 38 comprises an Eddy brake system. In particular, horizontal resistance source 38 includes a magnet 130 (schematically shown) positioned opposite to a ferromagnetic or ferrous member 132.

Magnet 130 comprises a magnetic member configured and located so as to apply a magnetic field to member 132. In the example illustrated, magnet 130 extends generally opposite to a face of member 132. The magnetic field applied to member 132 by magnet 130 creates eddy currents that themselves create opposing magnetic fields that resist relative rotation of member 132. By resisting relative rotation of member 132, pivotal movement of swing arms 33 and horizontal movement of footpads 32 is also resisted.

In the example illustrated, member 132 is coupled to and supported by rocker arm 110 to rotate in response to rocking of rocker arm 110. Magnet 130 is stationarily supported by upright 46 opposite to member 132. In other embodiments, magnet 130 may be coupled to and carried by rocker arm 110 so as to rotate in response to rocking of rocker arm 110, while member 132 is supported by upright 46 in a stationary manner opposite to magnet 130. Because horizontal resistance source 38 utilizes already existing components of footpad synchronizer 34 and swing arms 33, the number of parts, the volume or space consumed by resistance source 38 and complexity are reduced. In other embodiments, horizontal resistance source 38 may have other configurations. In other embodiments, horizontal resistance source 38 may alternatively not utilize components of one or both of synchronizer 34 or swing arms 33.

In the example illustrated, the resistance applied by magnet 130 is adjustable and selectable by a person exercising. In one embodiment, magnet 130 comprises an electro-magnet, wherein electrical current transmitted through magnet 130 may be varied to adjust the magnetic field and the degree of resistance provided by source 38. In one embodiment, the electrical current transmitted to magnet 130 varies in response to electrical circuitry and control signals generated by a controller associate with control panel 42 in response to input from the person exercising or an exercise program stored in a memory associated, connected to or in communication with the controller of control panel 42.

In another embodiment, the resistance applied by magnet 130 may be adjustable by physically adjusting a spacing or gap between member 132 and magnet 130. For example, in one embodiment, source 30 may include an electric solenoid, voice coil or other mechanical actuator configured to move one of member 132 or magnet 130 relative to one another so as to adjust the gap.

Control panel 42 comprises a panel by which a person exercising may view current settings of exercise device 20 and may adjust the current settings of exercise device 20. Control panel 42 may additionally provide a person excising with feedback as to his or her exercise routine, such as duration, calories burned and the like, or may provide the person exercising with instructions or objectives for an upcoming exercise routine are workout. In the example illustrated, control panel 42 includes display 154, input 156 and controller 158. Display 154 comprises a display configured to present information to a person excising. Display 154 may comprise a liquid crystal display, an array of light emitting diodes or other devices for providing visual information.

Input 156 comprises one or more mechanisms by which a person excising may enter selections are commands. Input 156 may comprise a touchpad, a touch screen, toggle switches, one or more buttons, a mouse pad, a scroll wheel, a slider bar or various other input devices. Controller 158 comprises one or more processing units connected to display 184 and input 156 as well as vertical resistance source 28 and horizontal resistance source 38. Controller 188 may also be connected to one or more sensors (not shown). Based on information received from their resistance sources 28 and 38, and the one or more sensors, controller 158 may generate control signals directing display 154 provide a person exercise with feedback as to his or her exercise routine or current settings of exercise device 20.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 158 may be embodied as part of one or more application-specific integrated circuits (ASICs). Unless otherwise specifically noted, the controller is not limited to any specific combination of hardware circuitry and software, nor to any particular source for the instructions executed by the processing unit. Based upon input received from into 156, controller 158 may generate control signals adjusting the resistance applied by resistance source 28 or resistance source 38. Such changes or adjustments may alternatively be made in response to stored programs or exercise routines associated with a memory of controller 158 or received by controller 158 through wired or wireless connections. In still other embodiments, display panel 42 may be omitted.

Overall, exercise device 20 provides a person exercising with multiple user selectable paths of motion for foot pads 32. A particular path a motion for foot pads 32 may be adjusted by user by the user simply applying different forces or directional forces to footpad 32 within his or her feet. Such changes in the motion paths may be made "on-the-fly" by the person excising during an exercise routine or workout without the person having to remove his or her hands from handgrips 98. Exercise devise automatically adapts to a person's motion or motion changes. Exercise device provides such freedom of motion with very few, if any, cantilevered members. For example, tracks 26 which support foot pads 32 are supported at opposite ends to have little, if any, cantilevered portions. At the same time, tracks 26 are arcuate or curved, providing a person with a more comfortable, smooth and desirable feel as footpad 32 are moved along various motion paths. As a result, exercise device 20 provides a more solid and stable feel, may be formed from less structurally rigid materials and may be lighter in overall weight.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise device comprising:

a frame;

a first curved track having a first portion pivotally connected directly to the frame;

a second curved track having a first portion pivotally connected directly to the frame;

a track drive connected to a second portion of the first curved track and a second portion of the second curved track, the track drive configured to raise and lower the first curved track and the second curved track, alternately, provide vertically opposed motions;

a first footpad movably supported along the first curved track, wherein movement of the first foot pad is independent of movement of the first curved track; and a second footpad movably supported along the second curved track, wherein forward and rearward movement of the second footpad is synchronized with rearward and forward movement, respectively, of the first footpad and wherein the first foot pad and the second foot pad are configured to change between a plurality of different available paths in response to force applied by a person to the first footpad and the second footpad;

a first swing arm pivotally coupled to the frame and pivotally connected to the first footpad; and a second swing arm pivotally coupled to the frame and pivotally connected to the second footpad.

2. The exercise device of claim 1, further comprising:

a horizontal resistance source configured to resist horizontal movement of the first footpad and the second footpad along the first curved track and a second curved track; and a vertical resistance source configured to resist vertical movement of the first curved track and the second curved track.

3. The exercise device of claim 2, wherein the horizontal resistance source is connected to the first swing arm and the second swing arm.

4. The exercise device of claim 3, further comprising a footpad synchronizer connected to the first swing arm and the second swing arm and configured to synchronize forward and rearward movement of the first footpad with rearward and forward movement of the second footpad, respectively.

5. The exercise device of claim 4, wherein the first swing arm and the second swing arm pivot about a first axis relative to the frame and wherein the footpad synchronizer comprises:

a rocker arm pivotally supported by the frame about a second axis perpendicular to the first axis;

a first link having a first end pivotally connected to the first swing arm and a second end pivotally connected to a first end of the rocker arm; and a second link having a first end pivotally connected to the second swing arm and a second end pivotally connected to a second end of the rocker arm.

6. The exercise device of claim 5, wherein the horizontal resistance source comprises:

a ferromagnetic member operably coupled to the rocker arm so as to rotate with the rocker arm; and one or more magnets configured to apply a magnetic field to the ferromagnetic member to resist rotation of the rocker arm and horizontal movement of the first footpad and the second footpad.

7. The exercise device of claim 6, wherein the one or more magnets comprises an electromagnet configured to apply selectively adjustable magnetic field to the ferromagnetic member.

8. The exercise device of claim 4, wherein the horizontal resistance source is connected to the footpad synchronizer.

9. The exercise device of claim 8, wherein the horizontal resistance source comprises of an eddy brake.

10. The exercise device of claim 2, wherein the horizontal resistance source is at a first end of the exercise device and wherein the vertical resistance source is at a second opposite end of the exercise device.

11. The exercise device of claim 1, wherein the track drive comprises a suspension assembly having a first pulley and one or more flexible members suspending a second portion of the first curved track and a second portion of the second curved track from the first pulley.

12. The exercise device of claim 11, wherein the track drive further comprises:

a second pulley coupled to the first pulley so as to rotate with the first pulley;

a third pulley rotationally supported by the frame;

a belt wrapped about the second pulley and the third pulley;

a flywheel rotationally supported by the frame; and a lever arm having a first portion eccentrically connected to the third pulley and a second portion eccentrically connected to the flywheel.

13. The exercise device of claim 12, wherein the flywheel is formed from a ferromagnetic material and wherein the exercise device further comprises one or more magnets opposite the flywheel.

14. The exercise device of claim 13, wherein the one or more magnets comprises an electromagnetic configured to apply a selectively adjustable magnetic field to the flywheel to resist rotation of the flywheel.

15. The exercise device of claim 11, wherein the one or more flexible members wrap about a lower portion of the first pulley.

16. The exercise device of claim 1, further comprising:

a horizontal resistance source configured to resist horizontal movement of the first footpad and the second footpad along the first curved track and a second curved track;

wherein the horizontal resistance source is connected to the first swing arm and the second swing arm.

17. The exercise device of claim 16, further comprising a footpad synchronizer connected to the first swing arm and the second swing arm and configured to synchronize forward and rearward movement of the first footpad with rearward and forward movement of the second footpad, respectively.

18. The exercise device of claim 17, wherein the horizontal resistance source is connected to the footpad synchronizer.

19. The exercise device of claim 1, wherein the first curved track has a radius of curvature of between 30 inches and 48 inches.

20. The exercise device of claim 1, wherein the track drive comprises a suspension assembly having a first pulley and one or more flexible members suspending a second portion of the first curved track and a second portion of the second curved track from the first pulley and wherein the first swing arm and the second swing arm are movable in response to movement of the first footpad and the second footpad along the first curved track and the second curved track, respectively, independent of movement of the first curved track and the second curved track.

21. The exercise device of claim 1, further comprising:

a first user adjustable resistance source configured to apply a first user adjustable resistance against reciprocation of the first footpad along the first curved track and the second footpad along the second curved track; and a second user adjustable resistance source configured to apply a second user adjustable resistance against raising and lowering of the second portion of the first curved track and the second portion of the second curved track, wherein the first user adjustable resistance source and the second user adjustable resistance source are configured to be adjusted to independently vary the first resistance relative to the second resistance.

22. An exercise device comprising:

a frame;

a first curved track having a first portion pivotally supported by the frame;

a second curved track having a first portion pivotally supported by the frame;

a track drive connected to a second portion of the first curved track and a second portion of the second curved track, the track drive configured to raise and lower the first track and the second track, alternately, provide vertically opposed motions, wherein the track drive comprises:

a first pulley;

one or more flexible members suspending a second portion of the first track and a second portion of the second track from the first pulley;

a second pulley coupled to the first pulley so as to rotate with the first pulley;

a third pulley rotationally supported by the frame;

a belt wrapped about the second pulley and the third pulley;

a flywheel rotationally supported by the frame; and a lever arm having a first portion eccentrically connected to the third pulley and a second portion eccentrically connected to the flywheel;

a first footpad movably supported along the first track; and a second footpad movably supported along the second track, wherein forward rearward movement of the second footpad is synchronized with rearward and forward movement, respectively, of the first footpad.

23. The exercise device of claim 22, wherein movement of the first foot pad is independent of movement of the first curved track.

* * * * *